US008969268B2

(12) United States Patent
Kumar et al.

(10) Patent No.: US 8,969,268 B2
(45) Date of Patent: Mar. 3, 2015

(54) PROCESS FOR THE PREPARATION OF MULTIFUNCTIONAL ADDITIVE FOR AQUEOUS LUBRICANTS

(75) Inventors: Chattterjee Alok Kumar, Uttarakhand (IN); Tyagi Mange Ram, Uttarakhand (IN); Ray Siddharth Sankar, Uttarakhand (IN); Shekhar Indu, Uttarakhand (IN); Bansal Ankushi, Uttarakhand (IN)

(73) Assignee: Council of Scientific & Industrial Research, New Delhi (IN)

( * ) Notice: Subject to any disclaimer, the term of this patent is extended or adjusted under 35 U.S.C. 154(b) by 230 days.

(21) Appl. No.: 13/421,697

(22) Filed: Mar. 15, 2012

(65) Prior Publication Data

US 2012/0238482 A1 Sep. 20, 2012

(30) Foreign Application Priority Data

Mar. 16, 2011 (IN) ..... 729/DEL/2011

(51) Int. Cl.

| | |
|---|---|
| ***C10M 159/12*** | (2006.01) |
| ***C10M 173/02*** | (2006.01) |
| ***C10M 145/16*** | (2006.01) |
| ***C10M 149/06*** | (2006.01) |

(52) U.S. Cl.

CPC ..... *C10M 173/02* (2013.01); *C10M 145/16* (2013.01); *C10M 149/06* (2013.01); *C10M 2209/086* (2013.01); *C10N 2230/06* (2013.01)

USPC ..... 508/454

(58) Field of Classification Search

CPC ..... C10M 159/00; C10M 159/005; C10M 159/12

USPC ..... 508/543, 575, 452, 454

See application file for complete search history.

(56) References Cited

U.S. PATENT DOCUMENTS

| | | | | |
|---|---|---|---|---|
| 3,518,197 | A * | 6/1970 | Eckert | 508/472 |
| 3,621,004 | A * | 11/1971 | Eckert | 526/320 |
| 4,452,712 | A | 6/1984 | Laemmle | |
| 4,828,735 | A | 5/1989 | Minagawa et al. | |
| 7,514,150 | B2 | 4/2009 | Spencer et al. | |

FOREIGN PATENT DOCUMENTS

EP 0 594 61 A1 9/1982

OTHER PUBLICATIONS

Duan, B. et al. "The Effect of particle size on the lubricating properties of colloidal polystyrene used as water based lubrication additive", WEAR, Jun. 2001, vol. 249, Issues 5-6, pp. 528-532.

Lei, H. et al. "Tribological behavior of fullerene-styrene sulfonic acid copolymer as waterbased lubricant additive", WEAR, 2002, vol. 252, No. 3, pp. 345-350. (Abstract Only).

* cited by examiner

*Primary Examiner* — Taiwo Oladapo

(74) *Attorney, Agent, or Firm* — Foley & Lardner LLP

(57) ABSTRACT

The present invention deals with a process for the preparation of multifunctional additive for aqueous lubricants. These I multifunctional additive for aqueous lubricant comprises of co-polymer having vinyl group containing polyhydric alcohol along with monomer selected from aqueous soluble acrylate co-monomer in different mole fraction for addition polymerization to facilitate the sequencing of monomer in polymer chain. Thus the polymeric molecule has been designed for improving tribological properties i.e. low wear, low friction and EP property of aqueous lubricants.

10 Claims, No Drawings

PROCESS FOR THE PREPARATION OF MULTIFUNCTIONAL ADDITIVE FOR AQUEOUS LUBRICANTS

RELATED APPLICATION

This application claims priority from Indian Patent Application No. 729/DEL/2011, filed Mar. 16, 2011, which is incorporated by reference in its entirety.

FIELD OF INVENTION

The present invention relates to a process for the preparation of multifunctional additive for aqueous lubricants Particularly, this invention relates to a process for making highly water soluble copolymer of vinyl group containing polyhydric alcohol by addition polymerization. More particularly the present invention represents simple ecofriendly process for the preparation of water soluble polymer of desired microstructure under mild polymerization condition. This invention provides a composition of aqueous lubricant having useful coefficient of friction and wear properties in tribological behavior also provides an economical method for producing aqueous lubricant for various uses.

BACKGROUND OF INVENTION

The present invention is in the field of tribology and specifically for reduction of frictional coefficient and wear on metal surfaces. The frictional force and wear are general phenomena for any machine and device under operational condition it reduces the efficiency and life of the machine whereas lubricants reduce the frictional resistance and wear of machine or device and increase their life and efficiency. However, many lubricants have their limited ability to perform under high load and sliding speed of machine or device. Aqueous lubricant composition has many advantages over oil as lubricants it can serve coolant to the sliding surface along with ecological and economic advantages. It has disadvantage of low pressure coefficient of viscosity, which decreases the ability to support high load. The prior art, Plaza S et al.; WEAR 249(12):1077-89(2001) describes a polyoxyethylenediphosphate derivative that appears to show some antiwear and friction reduction activity in aqueous solution. At a load 5N, all sample tested showed friction coefficient around 0.1. Lei H et al.; WEAR, 252(3-4):345-50(2002) describes a fullerene-styrene sufonicacid copolymer, which shows low (0.3) friction coefficient at the lowest loads which is reported at 100N. The wear scar is shown to be very sulfur rich after wear test. Duan B and Lei H, WEAR, 249(5-6); 528-32(2001) report the use of colloidal polystyrene as an additive to aqueous fluids such as triethanolamine aqueous solution and a water soluble zincalkoxyphosphate (OPZ) solution which showed the addition of colloidal polystyrene in this combination the base fluid appears to have a beneficial effect on the wear behavior of steel, as demonstrated by the maximum non-seizure load. However, the wear scar diameter did not reduce in comparison with colloid free solution. There was no mention of friction reduction behavior.

In the prior art, several patents disclosed the use of different polymer and copolymers in aqueous lubricants along with other components such as block copolymer of polyoxyethylene-polyoxypropylene (U.S. Pat. No. 4,452,712) about 0.1-20 wt % of water soluble mixture along with 0.5-10 wt % of water soluble alkanolamine to provide metal working lubricant to improve friction and corrosion inhibition ability. Again in patent (EP 0059461) discloses water based hydraulic fluids incorporating a polyether as a lubricant and corrosion inhibitor. (U.S. Pat. No. 4,828,735) discloses the aqueous composition of polyether along with polyamide component having suitable formulation for use as a hydraulic fluid, metal drawing fluid and aqueous cutting fluid.

The closest prior art is U.S. Pat. No. 7,514,150 B2. This patent has disclosed a copolymerization of polyionic backbone along with poly L-lysin and other similar molecules for polymerization with an objective of mixing it with aqueous medium as an additive.

Therefore, it is an object of the invention to provide a stable polymeric material that can be added easily and cost effectively to an aqueous medium to produce aqueous lubricant which can be used effectively to reduce friction and wear substantially. There are several important physical properties which are used to characterize the friction coefficient and wear for industrial aqueous lubricant. Some of the important methods are given below for better understanding of present invention.

Friction and wear properties were evaluated on a four ball test rig. The tests were conducted using standard 12.7 mm diameter EN31 steel balls, rotation speed of 1200 rpm, 196.2 N load, temperature of 54° C. and test duration of 60 minutes. The coefficient of friction was monitored throughout the test duration and wear scar diameter of the balls were measured at the end of the test.

EP properties of the lubricating additive were evaluated in a standard four ball m/c as per IP-239 test method.

The present invention is significantly different from prior art patents as described above for use of vinyl group containing polyhydric alcohol as comonomer for making aqueous lubricant additive.

OBJECTS OF THE INVENTION

The main object of the present invention is to provide a process for the preparation of multifunctional additive for aqueous lubricants which obviates the draw backs of the hitherto known prior art as detailed above.

Another object of the present invention is to provide a process for making aqueous lubricant using vinyl group containing polyhydric alcohol as comonomer.

Still another object of the present invention is to provide a cost effective process for making aqueous lubricant additive.

Yet another object of the present invention is to provide a process for making aqueous lubricant having low coefficient of friction.

Yet another object of the present invention is to provide a cost effective process for making aqueous lubricant additive having less wear.

Yet another object of the present invention is to provide a process for making aqueous lubricant having EP property also.

Yet another object of the present invention is to provide an ecofriendly green chemistry process for synthesis.

Yet another object of the present invention is to provide an ecofriendly molecule as aqueous lubricating additive.

Other object, features and advantages of the present invention will be set forth in part in the description which follows and in part will be obvious from description or may be understood by practice of the invention.

These and other object of this invention will be better understood and will become more apparent with reference to the following detailed description.

SUMMARY OF THE INVENTION

Accordingly, the present invention provides a process for the preparation of multifunctional additive for aqueous lubricants which comprises:

i) copolymerizing glycerolmonomaleate with comonomer selected from the group consisting of acryalamide and vinyl acetate in a molar ratio in the range of 1:1 to 1:3 in a solvent selected from water or dimethyl formamide along with ceric/thiourea redox initiator or benzoylperoxide at a temperature in the range of 50-70° C. under nitrogen flushing and stirring condition for a period of 5-8 hrs to obtain polymer, ii) optionally polymerizing glycerolmonomaleate with poly acryalamide, in a ratio of 1:5.26 to 1:4.26 wt basis in water at a temperature in the range of 60-90° C. at the pH of the medium 2-3 under nitrogen flushing and stirring condition for a period of 5-8 hrs to obtain polymer, iii) precipitating the polymer obtained in step i) and ii) in methanol or isopropyl alcohol to obtain desired product.

In an embodiment of the present invention the molar ratio of glycerolmonomaleate to vinyl acetate copolymer is 1:3.

In another embodiment of the present invention the molecular weight of copolymer polyacrylamide used in step (ii) is in the range of 15000-25000.

In another embodiment of the present invention the total wt % of the reaction mixture in the aqueous medium is in the range of 5-25 wt %. (total monomer concentration in reaction mixture of aqueous system).

In another embodiment of the present invention the polymerization temperature in step i) is preferably, in the range of 60-70° C.

In another embodiment of the present invention the polymerization temperature in step ii) is preferably, in the range of 70-80° C.

In another embodiment of the present invention benzoylperoxide is 0.1 wt % of comonomers.

In another embodiment of the present invention concentration of ceric/thiourea redox initiator is $1.5\times10^{-4}$(M)/$1\times10^{-5}$ (M).

In another embodiment of the present invention yield of additives is in the range of 31-92%.

In another embodiment of the present invention the polymers are easily soluble in aqueous medium without emulsifier for making aqueous lubricating additive.

DETAIL DESCRIPTION OF THE INVENTION

The present patent provides a process by which a highly energy efficient aqueous lubricant additive having low friction coefficient and low wear can be prepared by addition polymerization of vinyl group containing polyhydric alcohol along with comonomers in different mole fractions to facilitate the sequencing of monomer in polymer chain (MW 10000-20000) in aqueous medium by redox initiator to develop desired properties of the additive. The second method of preparation of aqueous lubricating additive is by grafting glycerolmonomaleate in polyacrylamide (10000-30000 MW) in aqueous medium by maintaining the pH and temperature at desired levels. This process provides a more economic way of making additive for aqueous lubricant. This process is mild being at atmospheric pressure and low temperature. Thus the process is highly energy efficient as well as the synthesized polymeric molecule has multifunctional tribological properties.

The vinyl group containing polyhydric alcohol which is a product of esterification of glycerol by maleic acid, thus glycerol have been transformed in to a multifunctional monomer having vinyl double bond, —OH group and —COOH group. Glycerol and maleic acid in 1:1 mole ratio taken in a 500 ml flask fitted with condenser and nitrogen inlet system and maintained a temperature of 120-150° C. under nitrogen flushing for more than ½ hour with continuous stirring to remove water formed in the reaction mixture. The yield of glycerolmonomaleate ester was more than 80-90%, have been estimated by proton NMR spectra by comparing the ratio of $CH_2O$— peak in reacted and unreacted glycerol. The formation of glycerolmonomaleate has been confirmed by IR and $^{13}C$ NMR spectra.

IR(neat) 3388, 2958, 2582, 1724, 1642, 1408, 1171, 1120, 1044, 987, 850, 822, 639, 593 $cm^{-1}$.

$^{13}C$ NMR (DMSO); 63.67 (—$CH_2OH$), 69.15 (—CHOH), 66.56 (—$CH_2O$—), 166.66 (═CO), 135 & 133.85 (—CH═CH—), 164.1 (—COOH).

The polymerization of acrylamide and glycerolmonomaleate have been performed in aqueous medium by taking 1-5 mole of acrylamide with 1 mole of glycerolmonomaleate and initiated by ceric/thiourea redox initiator at temperature of 50-70° C. under constant stirring and nitrogen flushing for 4-7 hours. The structure of the polymer has been confirmed by $^{13}C$ NMR.

$^{13}C$ NMR (DMSO); 25.39, 30.86, 31.67 (—$CH_2$—), 39.09 (═CH—), 63.21 (—$CH_2OH$), 65.49 (—$CH_2O$—), 69.28 (—CHOH), 162.52 (—COOH), 165.13 (—C═O), 166.56 (—$NH_2C$═O—).

Similarly, vinylacetate have been taken in place of acrylamide and under similar conditions polymerization have been performed.

In another method glycerolmonomaleate have been incorporated in polyacrylamide chain by grafting. 10% aqueous solution of polyacrylamide along with 1-3 g of glycerolmonomaleate have been taken in 500 ml flask fitted with condenser and nitrogen gas inlet system heated upto 60-80° C. under stirring and nitrogen flushing for 5-8 hours and solution pH kept at 2-3. At the end of the reaction polymer precipitated in isopropanol. By this method glycerolmonomaleate is grafted into the polyacrylamide chain.

The present invention is significantly different from prior art patents as no one used vinyl group containing polyhydric alcohol as comonomer for making aqueous lubricant additive.

The present invention uses low cost glycerol, maleicacid and vinyl monomers and simple method of esterification and polymerization processes which are mild in nature.

The present invention provides a novel multifunctional additive for aqueous lubricants which comprises of copolymer of glycerolmonomaleate and aqueous soluble acrylate monomer, these two monomers mixed in aqueous medium 5-25 wt % in the ratio of 0.25-6.0 mole fraction along with ceric/thiourea redox initiator and maintained the polymerization temperature 50-80° C. under nitrogen flushing and stirring condition for 4-9 hours and desired product is precipitated in non-solvent medium like methanol or isopropyl alcohol.

In present invention another method of making aqueous lubricating additive is polyacrylamide (MW 15000-30000) dissolved in aqueous medium 10-20 wt % along with glycerolmonomaleate 0.5-5.0 wt % and maintaining the pH of the medium 2-3 and maintained the temperature of the reaction mixture 60-90° C. for 6-8 hours under nitrogen flushing and stirring condition and precipitated in non-solvent medium like methanol or isopropyl alcohol to get the desired properties of aqueous lubricant additive. The one component of copolymer is glycerolmonomaleate in mole fraction 0.25-5.0. In the present invention the other component of copolymer is acrylamide in mole fraction 1.0-3.0. The other component of copolymer is vinylacetate in mole fraction 1.0-3.0. The other component of copolymer is acrylicacid in mole fraction 1.0-3.0. The other component of copolymer is polyacrylamide in molecular weight range 15000-25000. In the present invention the total wt % of the reaction mixture in the aqueous medium can be in the range of 5-15 wt %. The polymerization temperature can be in the range of 60-70° C. The glycerolmonomaleate can be incorporated as pendant in polymer chain. In the present invention polymer can be precipitated by methanol, isopropyl alcohol type non-solvents. The polymer can be synthesized in ecofriendly aqueous medium. In the present invention these polymers are easily soluble in aqueous medium without emulsifier for making aqueous lubricating additive.

The following examples are given by way of illustration of the working of the invention in actual practice and should not be construed to limit the scope of the present invention in any way.

Synthetic Example 1

Preparation of glycerolmonomaleate: A flask of 250 ml fitted with condenser and nitrogen gas flushing system, was charged with 18.4 g (0.2 mole) of glycerol, 23.28 (0.2 mole) of maleic acid and mixture was stirred and the reaction was carried out at an temperature of 120° C. for 30 minutes. The conversion of glycerolmonomaleate was 84.5%. The product has been characterized by IR, $^{1}H$ NMR and $^{13}C$ NMR: IR (neat) 3451.3, 2966, 2880.4, 1726, 1641.4, 1475.5, 1410, 1395, 1259, 1219, 1167, 1039, 1002, 949, 853, 821.9, 602, 532.1 ($cm^{-1}$); $^{13}C$ NMR (DMSO) 63.67 (—$CH_2OH$), 69.15 (—CHOH), 66.56 (—$CH_2O$—), 166.66 (—C═O), 135 and 1333.85 (—CH═CH—), 164.1 (—COOH) ppm., which have also been mentioned in detailed innovation para, with a structural formula $CH_2OHCHOHCH_2COOCH_2{=}CH_2$ COOH abbreviated as (A). This polyhydric-alcohol-ester compound is referred to as "Additive 1".

Synthetic Example 2

Preparation of polyacaryalamide: The reaction set up was same as in synthetic example 1. Here acrylamide 30 g (0.42 mole) taken in 150 ml dimethyl formamide solvent under nitrogen flushing and stirring at 70° C. temperature polymerization was carried out for 30 minutes after adding 0.1 wt % benzylperoxide as initiator. After 30 minutes the reaction mixture becomes viscous, then reaction flask was taken out from the thermostatic bath and slowly the reaction mixture have been poured into methanol (10 g of reaction mixture in 30 ml of methanol) under stirring condition to precipitate polyacrylamide batch wise to remove unreacted monomer which is soluable in methanol. Then, the product polyacrylamide was dried in vacuum oven at 40° C. The yield was 92% with a structural formula poly(2-propaneamide) and characterization have been done by IR spectra. The IR spectral band appeared at 1664 $cm^{-1}$ (sharp), NH stretching, 1607 $cm^{-1}$ (weak), 1324 $cm^{-1}$ and 1352 $cm^{-1}$ are for —C═O, N—H bending and C—N stretching respectively which are the characteristic of $CONH_2$ group. The spectral band of —CH═CH— vinyl group of monomers at 1730 $cm^{-1}$ is absent showing the product is free of monomer. Along with peaks at 1451 $cm^{-1}$, 1414 $cm^{-1}$, 1255 $cm^{-1}$, 1190 $cm^{-1}$, 1102 $cm^{-1}$ of vibrational, scissoring and rotational bands of $CH_2$, and $CH_3$ groups are characteristics of polymer chain. This product is referred to "Additive 2".

Synthetic Example 3

The reaction set up was same as in synthetic example 1. Here 19 g (0.1 mole) glycerolmonomaleate taken with T1 g (0.1 mole) acrylamide in 150 ml water under nitrogen flushing and stirring at 70° C. temperature polymerization was carried out for 7 hours after adding ceric initiator $1.5\times10^{-4}$ (M) (ceric ammonium sulphate have been prepared in 1N $H_2SO_4$ as $1\times10^{-2}$ (M) stock solution). This stock solution has been added volumetrically to the reaction mixture (1 ml) to maintain the ceric ion concentration of $1.5\times10^{-4}$ in reaction medium. Similarly 1.5 ml of thiourea stock solution of $1\times10^{-3}$ (M) has been added volumetrically to the reaction mixture to maintain the thiourea concentration of $1.0\times10^{-5}$ in reaction medium. At the end of the polymerization period viscosity of the reaction medium increases, then the polymer have been precipitated in isopropyl alcohol. 10 ml. of the reaction mixture have been poured into 30 ml. isopropyl alcohol under stirring condition to precipitate polymer free of monomer and dried in vacuum oven at 40° C. Yield is 31%. It has been characterized by IR as given below. A strong peak appeared at 3427 $cm^{-1}$ along with 3197 $cm^{-1}$ characteristic of —OH group appeared from —CH2OH and ═CHOH of glycerolmonomaleate. Other characteristic peaks of $CONH_2$ group appeared at 1660 $cm^{-1}$ (sharp) instead of 1664 $cm^{-1}$ and 1320 $cm^{-1}$, 1352 $cm^{-1}$, 1390 $cm^{-1}$ for ═C═O, ═NH bending along with other peaks at 1451 $cm^{-1}$, 1415 $cm^{-1}$, 173 $cm^{-1}$, 1104 $cm^{-1}$, 1044 $cm^{-1}$, 866.8 $cm^{-1}$ of —$CH_2$ and —$CH_3$ groups from polymer backbone. The same copolymerization has been carried out in dimethylformamide (DMF) solvent instead of water. The reaction parameters are as follows: glycerolmonomaleate 0.1 mole, acrylamide 0.1 mole, DMF 150 ml., temperature 60° C. and benzoylperoxide 0.1 wt % of monomers, time 7 hours. At the end of the reaction, mixture becomes viscous and it have been precipitated in methanol 10 ml reaction mixture in 30 ml methanol under stirring condition to remove unreacted monomers. And polymer have been dried in vacuum oven at 40° C. Yield is 54%. It has been characterized by IR as given below. A strong peak appeared at 3427 $cm^{-1}$ along with 3197 $cm^{-1}$ characteristic of —OH group appeared from —CH2OH and ═CHOH of glycerolmonomaleate. Other characteristic peaks of $CONH_2$ group appeared at 1660 $cm^{-1}$ (sharp) instead of 1664 $cm^{-1}$ and 1320 $cm^{-1}$, 1352 $cm^{-1}$, 1390 $cm^{-1}$ for ═C═O, ═NH bending along with other peaks at 1451 $cm^{-1}$, 1415 $cm^{-1}$, 1173 $cm^{-1}$, 1104 $cm^{-1}$, 1044 $cm^{-1}$, 866.8 $cm^{-1}$ of —$CH_2$ and —$CH_3$ groups from polymer backbone. In a general structure formula $((A)_x(\text{Acrylamide})_y)_n$ this is referred to as "Additive 3

Synthetic Example 4

The reaction set up was same as in synthetic example 1. Here 9.5 g (0.05 mole) glycerolmonomaleate taken with vinylacetate 12.9 g (0.15 mole) in 150 ml water under nitrogen flushing and stirring at 70° C. temperature polymerization was carried out for 7 hours after adding ceric initiator $1.5\times10^{-4}$ (M) (ceric ammonium sulphate have been prepared in 1N $H_2SO_4$ as $1\times10^{-2}$ (M) stock solution). This stock solution has been added volumetrically to the reaction mixture (1 ml) to maintain the ceric ion concentration of $1.5\times10^{-4}$ in reaction medium. Similarly 1.5 ml of thiourea stock solution of $1\times10^{-3}$ (M) has been added volumetrically to the reaction mixture to maintain the thiourea concentration of $1.0\times10^{-5}$ in reaction medium. At the end of the polymerization period viscosity of the reaction medium increases, then the polymer have been precipitated in isopropyl alcohol. 10 ml. of the reaction mixture have been poured into 30 ml. isopropyl alcohol under stirring condition to precipitate polymer free of monomer and dried in vacuum oven at 40° C. The yield is 43%. The product has been characterized by IR. IR spectrum shows a new band at 1750 $cm^{-1}$, which related to the ═C═O stretching and confirms the presence of —$OCOCH_3$ group of vinylacetate along with additional peaks at 2786 $cm^{-1}$ (weak), 1664 $cm^{-1}$ (strong), 1206 $cm^{-1}$ (weak) and 937 $cm^{-1}$ (weak) for the —O—H stretching and C═O stretching, C—O stretching and —O—H bending of —COOH group contain in glycerolmonomaleate respectively and other general peaks of $CH_2$ and $CH_3$ groups of polymer backbones. The same copolymerization have been carried out in dimethylformamide (DMF) solvent instead of water. The reaction parameters are as follows: glycerolmonomaleate 0.05 mole, vinylacetate 12.9 g (0.15 mole), DMF 150 ml., temperature 60° C. and benzoylperoxide 0.1 wt % of monomers, time 7 hours. At the end of the reaction, mixture becomes viscous and it has been precipitated in methanol 10 ml reaction mixture in 30 ml methanol under stirring condition to remove unreacted monomers. And polymer have been dried in vacuum oven at 40° C. Yield is 53%. The product has been characterized by IR. IR spectrum shows a new band at 1750 $cm^{-1}$, which related to the ═C═O stretching and confirms the presence of —$OCOCH_3$ group of vinylacetate along with additional peaks at 2786 $cm^{-1}$ (weak), 1664 $cm^{-1}$ (strong), 1206 $cm^{-1}$ (weak) and 937 $cm^{-1}$ (weak) for the —O—H stretching and C═O stretching, C—O stretching and —O—H bending of —COOH group contain in glycerolmonomaleate respectively and other general peaks of $CH_2$ and $CH_3$ groups of polymer backbones. This polymer has general structural formula $((A)_x(\text{Vinylacetate})_y)_n$ this referred to as "Additive 4".

Synthetic Example 5

The reaction set up was same as in synthetic example 1. Here 9.5 g (0.05 mole) glycerolmonomaleate taken with 10.6 g (0.15 mole) acrylamide in 150 ml water under nitrogen flushing and stirring at 70° C. temperature polymerization was carried out for 7 hours after adding ceric initiator $1.5\times10^{-4}$ (M) (ceric ammonium sulphate have been prepared in 1N $H_2SO_4$ as $1\times10^{-2}$ (M) stock solution). This stock solution has been added volumetrically to the reaction mixture (1 ml) to maintain the ceric ion concentration of $1.5\times10^{-4}$ in reaction medium. Similarly 1.5 ml of thiourea stock solution of $1\times10^{-3}$ (M) has been added volumetrically to the reaction mixture to maintain the thiourea concentration of $1.0\times10^{-5}$ in reaction medium. At the end of the polymerization period viscosity of the reaction medium increases, then the polymer have been precipitated in isopropyl alcohol. 10 ml. of the reaction mixture have been poured into 30 ml. isopropyl alcohol under stirring condition to precipitate polymer free of monomer and dried in vacuum oven at 40° C. Yield is 34%. It has been characterized by IR as given below. A strong peak appeared at 3427 $cm^{-1}$ along with 3197 $cm^{-1}$ characteristic of —OH group appeared from —CH2OH and ═CHOH of glycerolmonomaleate. Other characteristic peaks of $CONH_2$ group appeared at 1660 $cm^{-1}$ (sharp) instead of 1664 $cm^{-1}$ and 1320 $cm^{-1}$, 1352 $cm^{-1}$, 1390 $cm^{-1}$ for ═C═O, ═NH bending along with other peaks at 1451 $cm^{-1}$, 1415 $cm^{-1}$, 1173 $cm^{-1}$, 1104 $cm^{-1}$, 1044 $cm^{-1}$, 866.8 cm of —$CH_2$ and —$CH_3$ groups from polymer backbone. The same copolymerization have been carried out in dimethylformamide (DMF) solvent instead of water. The reaction parameters are as follows: glycerolmonomaleate 9.5 g (0.05 mole), acrylamide 10.6 g (0.15 mole), DMF 150 ml., temperature 60° C. and benzoylperoxide 0.1 wt % of monomers, time 7 hours. At the end of the reaction, mixture becomes viscous and it have been precipitated in methanol 10 ml reaction mixture in 30 ml methanol under stirring condition to remove unreacted monomers. And polymer have been dried in vacuum oven at 40° C. Yield is 44%. It has been characterized by IR as given below. A strong peak appeared at 3427 $cm^{-1}$ along with 3197 $cm^{-1}$ characteristic of —OH group appeared from —CH2OH and ═CHOH of glycerolmonomaleate. Other characteristic peaks of $CONH_2$ group appeared at 1660 $cm^{-1}$ (sharp) instead of 1664 $cm^{-1}$ and 1320 $cm^{-1}$, 1352 $cm^{-1}$, 1390 $cm^{-1}$ for ═C═O, ═NH bending along with other peaks at 1451 $cm^{-1}$, 1415 $cm^{-1}$, 1173 $cm^{-1}$, 1104 $cm^{-1}$, 1044 $cm^{-1}$, 866.8 $cm^{-1}$ of —$CH_2$ and —$CH_3$ groups from polymer backbone. In a general structure formula $((A)_x(\text{Acrylamide})_y)_n$ this is referred to as "Additive 5".

Synthetic Example 6

The reaction set up was same as in synthetic example 1. Here 20.0 g polyacrylamide (15000 Number Average Molecular Weight) taken with 3.8 g glycerolmonomaleate (0.02 mole) in 150 ml water under nitrogen flushing and stirring at 80° C. temperature, at pH 2.4. Reaction continued for 7 hours and then polymers have been precipitated batch wise in isopropyl alcohol. In each batch 20 ml of reaction mixture added to 40 ml of isopropyl alcohol under stirring condition. Total yield is 92 wt %. This product has been characterized by IR. The characteristic peak of glycerolmonomaleate along with grafted polyacrylamide have been appeared at 3451 $cm^{-1}$, 3198 $cm^{-1}$, 3056 $cm^{-1}$, 1726 $cm^{-1}$, 1641 $cm^{-1}$, 1495 $cm^{-1}$, 1395 $cm^{-1}$, 1348 $cm^{-1}$, along with 1451 $cm^{-1}$, 1414 $cm^{-1}$, 1255 $cm^{-1}$, 1190 $cm^{-1}$, 853 $cm^{-1}$ of polymer backbone containing $CH_2$ groups. The general structure of the polymer is Poly(2-propaneamide-g-A), this referred to as "Additive 6".

Example 1-6

A aqueous solution of 2-10 wt % of additive 1-6 have been prepared and the performance of the respective aqueous lubricating additive were evaluated by means on a four ball test rig using standard EN31 steel balls of 12.7 mm diameter, rotation speed of 1200 rpm, 196.2 N load, at temperature of 54° C. and test duration of 60 minutes. The coefficient of friction was monitored throughout the test duration and wear scar diameter of the balls were measured at the end of the test. The test results are given in Table-1.

EP properties were measured by four ball test rig, IP-239 test method. (Test conditions: Test specimen 12.7 mm standard EN-31 steel balls, rotation speed 1450 rpm, room temperature, step loading till failure, test duration 10 s at each load.)

TABLE-1

| Example No. | Coefficient of friction, f | Wear (WSD) mm | Weld Load (IP-239), Kgf |
|---|---|---|---|
| Additive 1 | | | |
| 10% aqueous solution | 0.03 | 0.725 | — |
| Additive 2 | | | |
| 10% aqueous solution | 0.1 | 0.683 | — |
| Additive 3 | | | |
| 5% aqueous solution | 0.06 | 0.958 | — |
| Additive 4 | | | |
| 10% aqueous solution | 0.11 | 1.008 | — |
| Additive 5 | | | |
| 5% aqueous solution | 0.06 | 1.03 | — |
| 10% aqueous solution | 0.03 | 0.516 | — |
| Additive 6 | | | |
| 7% aqueous solution | <0.02 | 0.783 | 215 |

The innovative component of this patent is the use of functionalization of low value glycerol which is a co-product during biodiesel production. The proposed method of production of aqueous lubricant additive using glycerolmonomaleate along with comonomers is an innovative and simple. The production of aqueous lubricant additive by this method has not been reported in earlier literature.

The main advantages of the present innovation are:

1. This invention provides a process for making an aqueous lubricant additive using functionalized glycerol which is a byproduct of biodiesel. Thus an important and effective value addition of the byproduct.
2. In the present invention, the reaction temperature is 60-80° C. under atmospheric pressure which is mild and easy to handle.
3. In the present invention, the polymer made is highly water soluable and mix homogeneously that does not need any emulsifier.
4. In the present invention, the aqueous solution of the polymer has longer stability.
5. In the present invention, the additive drastically reduces both coefficient of friction and wear.
6. In the present invention, it has extreme pressure (EP) property also.
7. In the present invention, the aqueous lubricant additive has all the three properties in a single component molecule, i.e. low coefficient of friction, low wear and EP property required for an efficient lubricant additive.
8. This additive molecule is highly eco-friendly.

We claim:

1. A process for the preparation of multifunctional additive for aqueous lubricants which comprises:

(i) copolymerizing glycerolmonomaleate with comonomer selected from the group consisting of acrylamide and vinyl acetate in a molar ratio in the range of 1:1 to 1:3 in a solvent selected from water or dimethyl formamide along with ceric/thiourea redox initiator or benzoylperoxide at a temperature in the range of 50-70° C. under nitrogen flushing and stirring condition for a period of 5-8 hrs to obtain polymer, (ii) optionally polymerizing glycerolmonomaleate with poly acrylamide, in a ratio of 1:5.26 to 1:4.26 wt basis in water at a temperature in the range of 60-90° C. at the pH of the medium 2-3 under nitrogen flushing and stirring condition for a period of 5-8 hrs to obtain polymer, (iii) precipitating the polymer obtained in step i) and ii) in methanol or isopropyl alcohol to obtain desired product.

2. A process as claimed in claim 1, wherein the molar ratio of glycerolmonomaleate to vinyl acetate copolymer is 1:3.

3. A process as claimed in claim 1, wherein the molecular weight of polyacrylamide used in step (ii) is in the range of 15000-25000.

4. A process as claimed in claim 1, wherein the total wt % of the reaction mixture in the aqueous medium is in the range of 5-25 wt % total monomer concentration in reaction mixture of aqueous system).

5. A process as claimed in claim 1, wherein the polymerization temperature in step i) is in the range of 60-70° C.

6. A process as claimed in claim 1, wherein the polymerization temperature in step ii) is in the range of 70-80° C.

7. A process as claimed in claim 1, wherein benzoylperoxide is 0.1 wt % of comonomers.

8. A process as claimed in claim 1, wherein concentration of ceric/thiourea redox initiator is $1.5\times10^{-4}$ (M)/$1\times10^{-5}$ (M).

9. A process as claimed in claim 1, wherein the multifunctional additive for aqueous lubricants is obtained in a yield in the range of 31-92%.

10. A process as claimed in claim 1, wherein the polymers are easily soluble in aqueous medium without emulsifier for making aqueous lubricating additive.

* * * * *